US010472131B2

(12) United States Patent
Martial

(10) Patent No.: US 10,472,131 B2
(45) Date of Patent: Nov. 12, 2019

(54) BAG HAVING A CONCEALED OPENING

(71) Applicant: S2F FLEXICO, Henonville (FR)

(72) Inventor: Romain Martial, L'Isle Adam (FR)

(73) Assignee: S2F FLEXICO, Henonville (FR)

( * ) Notice: Subject to any disclaimer, the term of this patent is extended or adjusted under 35 U.S.C. 154(b) by 0 days.

(21) Appl. No.: 15/565,384

(22) PCT Filed: Apr. 8, 2016

(86) PCT No.: PCT/EP2016/057842
§ 371 (c)(1),
(2) Date: Oct. 24, 2017

(87) PCT Pub. No.: WO2016/162534
PCT Pub. Date: Oct. 13, 2016

(65) Prior Publication Data

US 2018/0118414 A1 May 3, 2018

(30) Foreign Application Priority Data

Apr. 10, 2015 (FR) ..... 15 53143
Oct. 28, 2015 (FR) ..... 15 60314

(51) Int. Cl.
*B65D 33/25* (2006.01)

(52) U.S. Cl.
CPC ..... *B65D 33/2541* (2013.01)

(58) Field of Classification Search
CPC ..... B65D 33/2541; B65D 33/255
(Continued)

(56) References Cited

U.S. PATENT DOCUMENTS 4,817,188 A 3/1989 Van Erden
4,878,763 A 11/1989 Ausnit
(Continued)

FOREIGN PATENT DOCUMENTS

EP 1712483 A1 10/2006
EP 2420454 A1 2/2012
(Continued)

OTHER PUBLICATIONS

Preliminary Research Report and Written Opinion received for French Application No. 1560314, dated May 30, 2016, 12 pages (1 page of French Translation Cover Sheet and 11 page of original document).

(Continued)

*Primary Examiner* — Jes F Pascua
(74) *Attorney, Agent, or Firm* — Womble Bond Dickinson (US) LLP

(57) ABSTRACT

Sachet comprising: a first and a second wall (10, 20), a closure assembly (3) comprising a first and a second support web (30, 32) that are connected to the first and the second wall (10, 20), respectively, and each have a closure element (34), the first support web (30) being connected discontinuously along its length to the first wall (10) of the sachet (1) so as to form at least one passage (40) between this first support web (30) and the first wall (10) of the sachet (1) from the outside of the sachet (1), said passage (40) allowing local deformation of the first support web (30) for modifying the relative local orientation of the closure elements (34) while the walls (10, 20) are being moved apart and making it easier to separate the closure elements (34).

18 Claims, 11 Drawing Sheets

(58) Field of Classification Search
USPC ..... 383/63, 65
See application file for complete search history.

(56) References Cited

U.S. PATENT DOCUMENTS

| | | | | |
|---|---|---|---|---|
| 5,647,100 | A * | 7/1997 | Porchia | B65D 33/2508 24/30.5 R |
| 7,340,807 | B2 * | 3/2008 | Dais | B65D 33/2541 24/443 |
| 7,967,509 | B2 * | 6/2011 | Turvey | B65D 33/2508 383/100 |
| 7,988,359 | B1 | 8/2011 | Sussman et al. | |
| 10,005,592 | B2 * | 6/2018 | Takigawa | B65D 33/2566 |
| 2009/0245699 | A1 | 10/2009 | Steele | |
| 2012/0045151 | A1 * | 2/2012 | Eouzan | B65D 33/2541 383/42 |
| 2013/0177266 | A1 * | 7/2013 | Mack | B65D 33/01 383/203 |
| 2014/0161374 | A1 | 6/2014 | Septien et al. | |
| 2014/0270585 | A1 * | 9/2014 | Heckman | B65D 33/2508 383/63 |
| 2016/0122087 | A1 * | 5/2016 | Takigawa | B65D 33/2508 383/63 |
| 2016/0152382 | A1 * | 6/2016 | Heckman | B65D 33/2508 383/63 |
| 2017/0190476 | A1 * | 7/2017 | Goto | B65D 33/25 |

FOREIGN PATENT DOCUMENTS

| | | | |
|---|---|---|---|
| FR | 1458288 | A | 3/1966 |
| FR | 1553143 | | 1/1969 |
| FR | 2628067 | A1 | 9/1989 |
| FR | 2963927 | A1 | 2/2012 |
| GB | 1116460 | A | 6/1968 |
| GB | 2458645 | A | 9/2009 |
| JP | 2000-072156 | A | 3/2000 |
| WO | 2002/074645 | A2 | 9/2002 |
| WO | 2009/130177 | A1 | 10/2009 |
| WO | 2012/075007 | A1 | 6/2012 |
| WO | 2013/076120 | A1 | 5/2013 |

OTHER PUBLICATIONS

International Search Report and Written Opinion received for PCT Patent Application No. PCT/EP2016/076043, dated Dec. 13, 2016, 21 pages (10 pages of English Translation and 11 pages of Original Document).

International Preliminary Report on Patentability received for PCT Patent Application No. PCT/EP2016/076043, dated May 11, 2018, 16 pages (9 pages of English Translation and 7 pages of Original Document).

Preliminary Research Report and Written Opinion received for French Application No. 1553143, dated Dec. 4, 2015, 8 pages (1 page of French Translation Cover Sheet and 7 page of original document).

International Search Report and Written Opinion received for PCT Patent Application No. PCT/EP2016/057842, dated Jun. 10, 2016, 22 pages (10 pages of English Translation and 12 pages of original Document).

International Preliminary Report on Patentability received for PCT Patent Application No. PCT/EP2016/057842, dated Oct. 19, 2017, 17 pages (9 pages of English Translation and 8 pages of original Document).

* cited by examiner

BAG HAVING A CONCEALED OPENING

FIELD OF THE INVENTION

The present invention relates to the field of packaging bags.

More precisely, the present invention relates to the field of packaging bags comprising opening/closing means, for example and non-limiting in the form of complementary profiles.

TECHNOLOGICAL BACKGROUND

Many packaging bags and many closure devices for this purpose have already been proposed.

Most closure devices known for this purpose comprise two complementary profiles, for example of male/female type or of type velvet/hooks, or even complementary hook type, borne by respective support webs.

Document FR 2 628 067 especially has proposed a bag comprising two main walls comprising two complementary closure profiles borne by respective support webs fixed respectively to the walls. The fastening area of the support web on the wall is not superposed on the male profile but is offset relative to the latter to hinge the corresponding support web on the wall at the fastening area. As is described in document FR 2 628 067, the preceding arrangement prevents internal pressure on the bag from being applied to the closure profiles and tends to separate the latter. In fact, the separation of the walls of the bag (for opening the latter) results in possible pivoting of the support web at the hinge area formed by its fastening, without risk of separation of the closure profiles.

Bags responding to this arrangement have already given considerable service and make reopening of the bag difficult, so as to assure its user that its contents cannot spill out easily.

It has also been proposed in document FR 2 963 927 for the two areas fastening of the webs to be located at a distance from and on either side of the corresponding complementary profiles such that one of the hinged webs is directed towards the interior of the bag while the other hinged web is directed towards its mouth.

These bags resist even more the internal and external stresses of the walls of the bag, at which point it is proving very difficult today to open them without damaging the closure device or the walls of the bag.

But in some cases, it can prove necessary for the bag to be opened without damaging it to access its contents and being sure of being able to reclose it after opening.

Such a bag applies for example to the field of the packaging of noxious products such as dishwater tablets. In fact, it is important to be able to assure users that the bag stays closed between two uses especially to prevent children from accessing its contents, with the possibility for parents to open and reclose the bag a number of times without risking damaging it, and preferably without the successive opening and closing being too difficult.

SUMMARY OF THE INVENTION

A first aim of the invention is therefore to propose a bag comprising opening/closing means, for example and non-limiting in the form of complementary profiles, and having a system enabling easy opening of said opening/closing means. If needed, when the opening means are hinged on one and/or the other of the walls of the bag, the system must let an adult open a bag despite the hinge effect generated by the articulation.

For this, the invention proposes a bag comprising:

- a first and a second wall connected together so as to define lateral sides and a bottom of the bag,
- a closure assembly comprising a first and a second support web connected respectively to the first and to the second wall and each comprising a complementary closure element.

The first support web is connected discontinuously over its length to the first wall of the bag so as to create at least one passage between this first support web and the first wall of the bag from the exterior of the bag. This passage thus enables local deformation of the first support web for modifying the relative local orientation of the closure elements when the walls of the bag are moved apart and makes for easy separation of the complementary closure elements.

Some preferred but non-limiting characteristics of the bag described are the following, taken individually or in combination:

- the first support web has an upper edge and a lower edge, the lower edge being closer to the bottom of the bag than the upper edge and the upper edge being connected discontinuously to the first wall of the bag, so as to create the passage,
- the upper edge of the first support web is fixed continuously to the first wall along a first section and is separated continuously from said first wall along a second section, and the lower edge of the first support web is fixed continuously on the first wall along the second section over all or part of its height,
- the lower edge of the first support web is connected to the first wall continuously between the lateral sides of the bag,
- the first support web is divided into a lower part and an upper part, the lower part being closer to the bottom than the upper part and bearing the closure element, and wherein the upper part of the first support web is connected discontinuously to the first wall so as to create the passage,
- the first support web is divided into a lower part and an upper part, the lower part being closer to the bottom than the upper part and bearing the closure element, and wherein the upper part of the first support web is locally cut out so as to create the passage,
- the passage has a length, in the direction extending between the sides of the bag, comprised between 12 mm and 35 mm,
- the second support web is hinged on the second wall such that the traction on the walls of the bag when the complementary closure elements are engaged causes the rotation of the support webs around said complementary closure elements,
- the second support web is fixed on the second wall in a localized area which is not superposed with the closure element and which is offset relative to said closure element, such that the second support web is hinged on the second wall,
- the second support web is divided into a lower part and an upper part, the lower part being closer to the bottom than the upper part and bearing the closure element, and wherein the localized area at which is fixed the second support web on the second wall forms part of the lower part of said second support web,
- the upper part of the second support web has a height less than a height of the closure element, the first and the second support web are connected to the first and to the second wall by means of a first and a second extension web, respectively, at least one of the support webs being fixed to the extension web at a distance from its upper edge, the at least one support web is fixed to the corresponding extension web in an adjacent area to the complementary closure element carried by said support web, the bag further comprises a supplementary wall having a first panel and a second panel, the first panel being connected to the second wall near the mouth of the bag while the second panel is connected to the first wall, said supplementary wall being folded between the first panel and the second panel along a fold such that the first panel extends in the direction of the bottom, and wherein the first support web and the second support web (32) are fixed on the first wall, and the second support web is further fixed on the second panel of the supplementary wall, the second panel of the supplementary wall is fixed near the lateral sides of the first wall, between the second support web and the fold, the complementary closure elements each comprise at least one complementary profile, preferably at least two complementary profiles, for example between three and six complementary profiles, and/or all or part of the complementary profiles comprises sequential alterations substantially parallel to the lateral sides, typically sequential crushings.

A second aim of the invention is to propose a packaging bag which is capable of resisting internal and external stresses of the walls of the bag and enables easy opening and closing of its mouth by a user other than a child, especially to prevent access inside the bag by children and enabling the user to open and close the bag a number of times without risking damaging it.

For this, the invention proposes a bag comprising:

a first and a second wall, each comprising a lower edge and an upper edge connected together by lateral sides, a closure device comprising a first and a second support web each comprising at least one complementary profile, the first and the second support web being fixed near the lateral sides of the second wall, and a supplementary wall, comprising a first panel and a second panel, the first panel being fixed along the upper edge of the second wall while the second panel is fixed on the first wall.

The supplementary wall is folded between the first panel and the second panel along a fold, such that the second panel extends in the direction of the upper edge of the first wall. Also, the first support web and the second support web are fixed on the first wall, the second support web being further fixed on the second panel of the supplementary wall such that a stress moving the first and the second wall of the bag apart when the complementary profiles are engaged causes the rotation of the closure device around the second support web.

Some preferred but non-limiting characteristics of the bag according to this second aspect are the following, taken singly or in combination:

the second panel of the supplementary wall is fixed near the lateral sides of the first wall, between the first support web and the fold, the second support web comprises an upper part bearing the at least one complementary profile and a lower part extending in the extension of the upper part, from the complementary profile, the upper part being closer to the upper edge of the first wall than the lower part and the second support web being fixed on the first wall at the upper part, the lower part being at least partially free relative to said first wall, a passage between the upper part and the first wall is made to form an access area to a region of the first wall which extends facing the at least one complementary profile of the second support web, such that the upper part is divided into three consecutive sections between the two lateral sides of the first wall, specifically: a first section, extending between one of the lateral sides of the first wall and the access area, a second section, extending along the access area, between the first section and the third section, and a third section, extending between the access area and the other lateral side of the first wall, the second support web is fixed along the first and of the third section, but left free relative to the first wall along the second section to form the passage, said passage passing between the upper part and the first wall, only one region of the second support web which extends between the complementary profiles and the upper edge of the first wall is fixed on the first wall, the region bearing the at least one complementary profile being free relative to said first wall, the upper part comprising a slot passing along the second section, to the limit of the complementary profiles, a region of the upper part which extends from the at least one complementary profiles along the second section is cut out to form the passage, said passage passing between the upper part and the first wall, the second section of the upper part extends over a length between 1.5 centimeters and three centimeters along the upper part of the second support web, for example between 12 millimeters and thirty-five millimeters, the lower part can be fixed to the first wall along the second section and close the passage, the first support web comprises an upper part bearing the at least one complementary profile and a lower part extending in the extension of the upper part, from the complementary profile, the upper part being closer to the upper edge of the first wall than the lower part, and wherein a height of the upper part of the first support web is substantially equal to a height of the complementary profiles, such that the upper part does not exceed the complementary profiles, the supplementary wall is formed fully and in a single piece with the second wall and extends in the extension of said second wall, or the supplementary wall is applied to and fixed on the second wall, near its upper edge so as to extend in the direction of the lower edge of said second wall, or the supplementary wall is applied to and fixed on the second wall, at a distance from its upper edge, for example in a region adjacent to the fold, the first support web is formed fully with the supplementary wall or is applied to and fixed on the supplementary wall, the first wall and the second wall are welded together along their lateral sides between the fold and their upper edge, the second support web is fixed at a distance from the upper edge of the first wall, the fold extends at a distance comprised between 30 and 70 millimeters, typically of the order of forty millimeters, from the upper edge of the second wall, the first and the second support web each comprise at least two complementary profiles, preferably at least three, for example between three and six, and/or all or part of the complementary profiles comprises sequential alterations perpendicular to the upper edge of the associated wall, typically sequential crushings.

BRIEF DESCRIPTION OF THE DRAWINGS

Other characteristics, aims and advantages of the present invention will emerge more clearly from the following detailed description and in conjunction with the appended drawings given by of non-limiting examples and in which.

DETAILED DESCRIPTION OF AN EMBODIMENT

Figure 1:
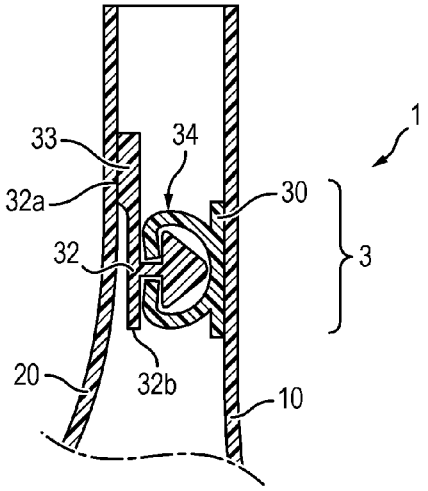
FIG. 1 illustrates a sectional transversal view of a first embodiment of a bag according to the invention, the bag being at rest.

A bag 1 comprises conventionally and per se a first and a second wall 10, 20 connected together so as to define lateral sides and a bottom 2 of the bag 1, as well as a mouth, extending opposite its bottom 2.

The bag 1 can be made by means of a single sheet folded back on itself and is welded on two sides, or several sheets, for example two sheets welded together on their sides, preferably along ridges joining the walls and forming the lateral sides and the bottom 2 of the bag 1.

The bag 1 also comprises a closure assembly 3. The closure assembly 3 extends near the mouth.

The closure assembly 3 comprises a first and a second support web 30, 32 connected respectively to the first and to the second wall 10, 20. Each support web 30, 32 bears at least one complementary closure element 34, for example of complementary profile type, velvet/hook strip, etc.

The first support web 30 has an upper part 30*a* and a lower part 30*b*, the upper part 30*a* being closer to the mouth of the bag 1 than the lower part 30*b*. The lower part 30*b* also bears all or part of the closure element 34.

To enable local deformation of the first support web 30 for modifying the relative local orientation of the closure elements 34 when the walls of the bag 1 are moved apart and make opening of the closure assembly 3 easy, the first support web 30 is connected discontinuously over its length to the first wall 10 of the bag 1 so as to create at least one passage between this first support web 30 and the first wall 10 of the bag 1, from the exterior of the bag 1.

Figure 7:
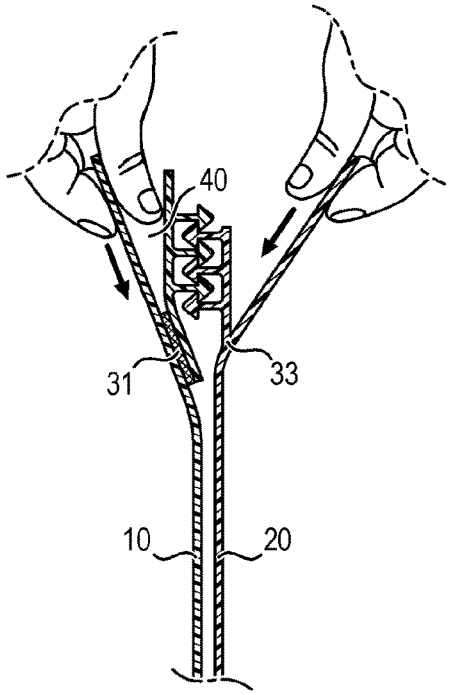
FIG. 7 is a sectional view of the bag of FIG. 6*a*, along axis B-A illustrated in FIG. 6*a*, when a user inserts one of his thumbs into the passage and places the other of his thumbs along the second wall.
Figure 8A:
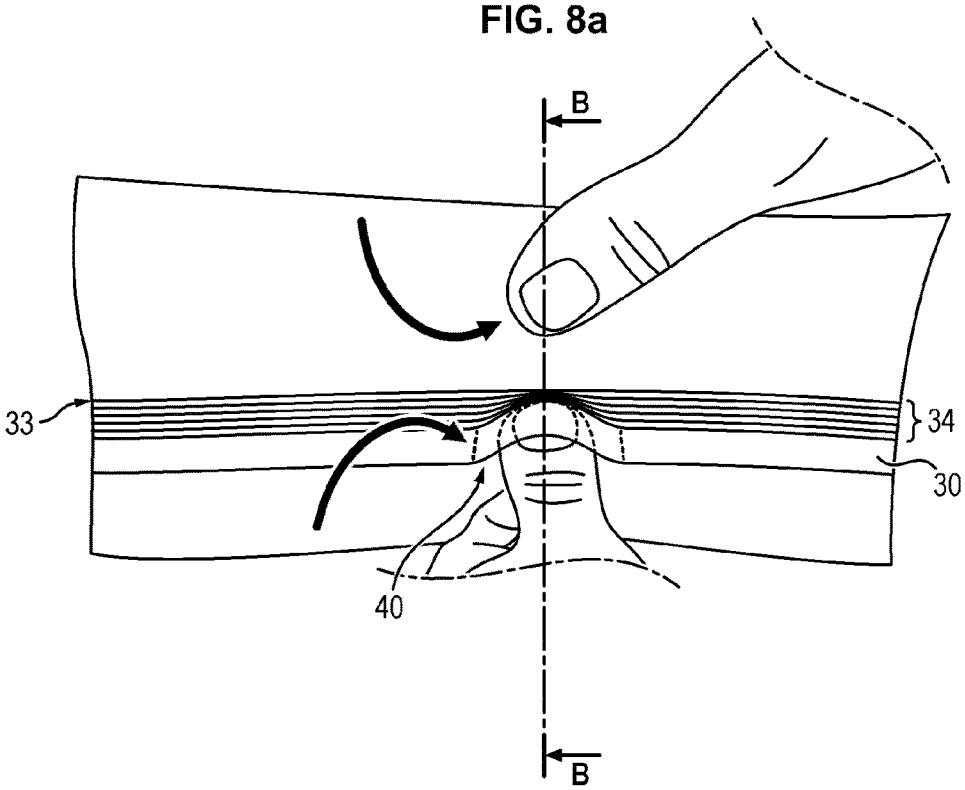
FIG. 8*a* is a plan view of the bag of FIG. 6*a* when a user utilizes the passage and is about to separate the closure elements.

This configuration is particularly advantageous in the case of a bag 1 whereof the closure assembly 3 is difficult to open, such as a closure assembly 3 hinged on at least one of the walls of the bag 1, but applies also when the closure assembly 3 is conventional (not hinged). In fact, opening the closure assembly 3 requires a user to:

introduce one of his thumbs from the exterior of the bag 1—or via the mouth—so as to grip the second wall 20, preferably near the closure element 34 of the second support web 32, introduce his second thumb in the mouth of the bag 1 in the passage 40 formed between the first wall 10 and the first support web 30 (see FIG. 7). In this position, the support webs are substantially parallel to each other, and move the walls apart by applying force to said walls via the first thumb and the second thumb shown in FIG. 8*b*) which extends substantially perpendicularly to the plane of the closure assembly 3 (see FIGS. 8*a* and 8*b*).

Figure 8B:
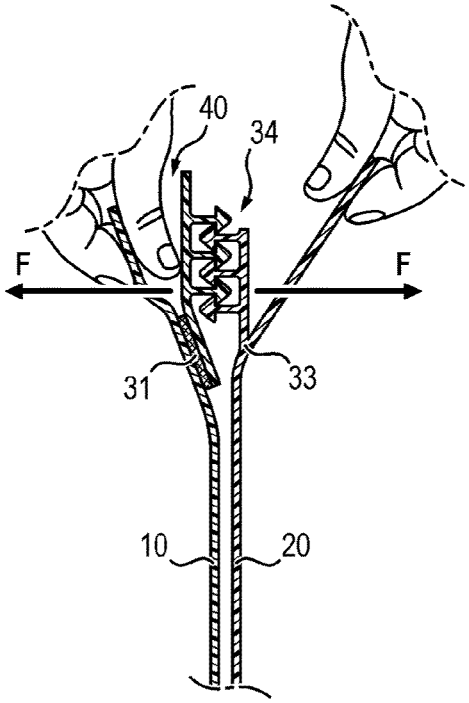
FIG. 8*b* is a sectional view of the bag of FIG. 8*a*, along axis B-B illustrated in FIG. 7.
Figure 9:
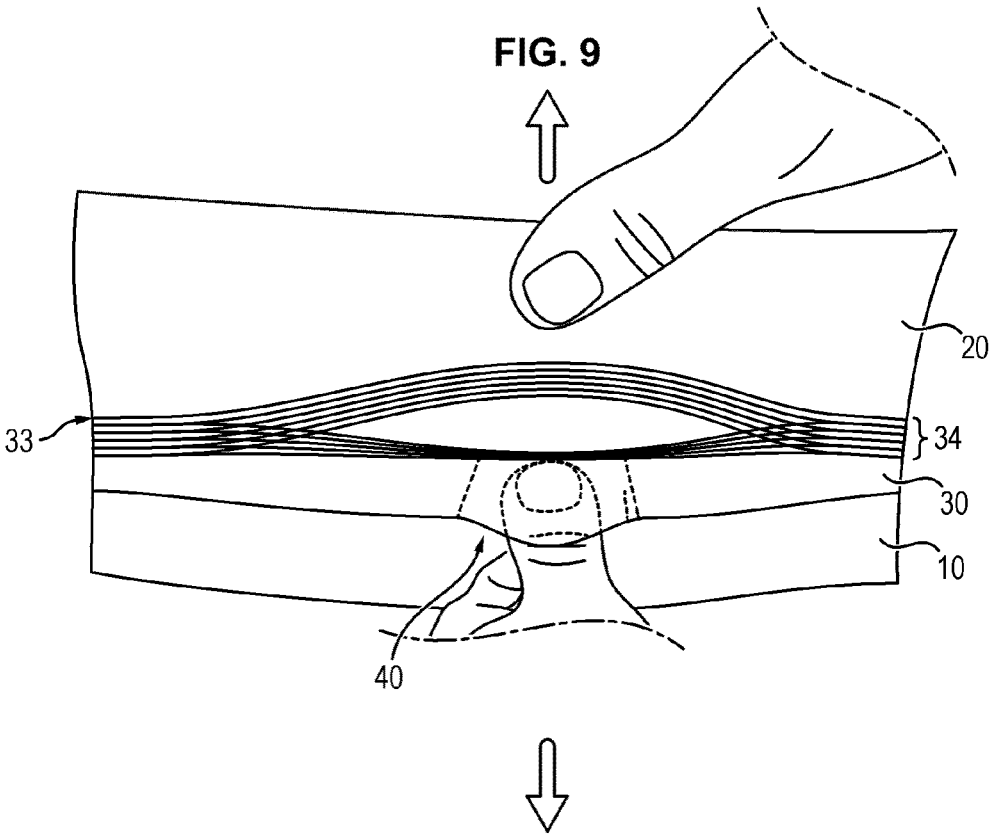
FIG. 9 is a plan view of the bag of FIG. 6*a* when the closure elements are being separated.
Figure 10:
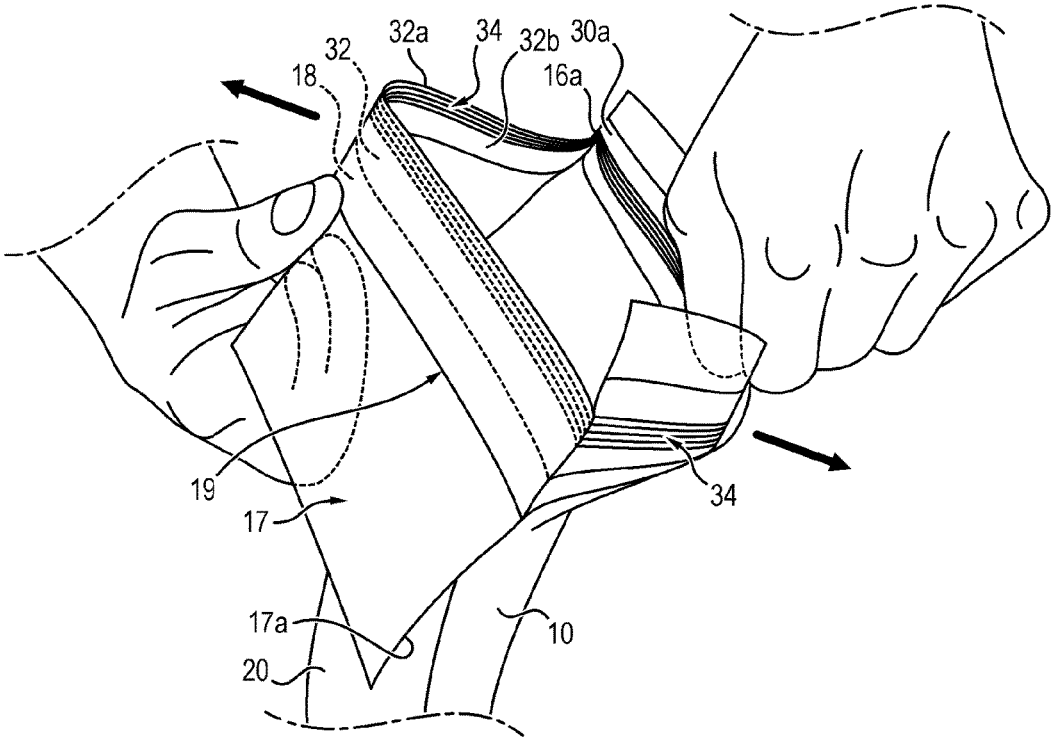
FIG. 10 is a perspective view of the bag of FIG. 5*a* after opening by means of the passage.

In practice, the passage 40 locates the point of application of the force at the closure element 34 of the first support web 30, or even of the lower part of the first support web 30 (according to the height of the passage 40) (see FIG. 8*b*). In this way, in the event where the second support web 32 is hinged, as the walls are being moved apart, gripping the first wall 10 behind the first support web 30 limits the rotation of the closure assembly 3 and therefore bring the direction of application of the force on the closure elements 34 closer to the direction of separation.

Figure 6A:
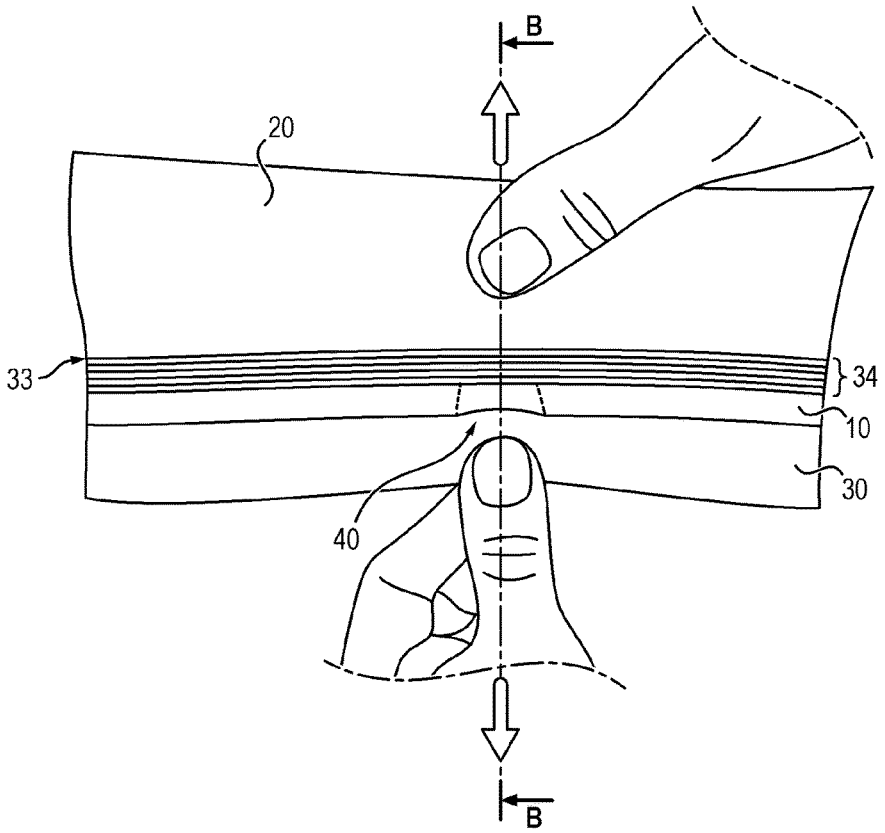
FIG. 6*a* is a plan view of a variant embodiment of the first embodiment of a bag according to the invention, comprising the easy opening of FIG. 5, when a user tries to open the bag conventionally.
Figure 6B:
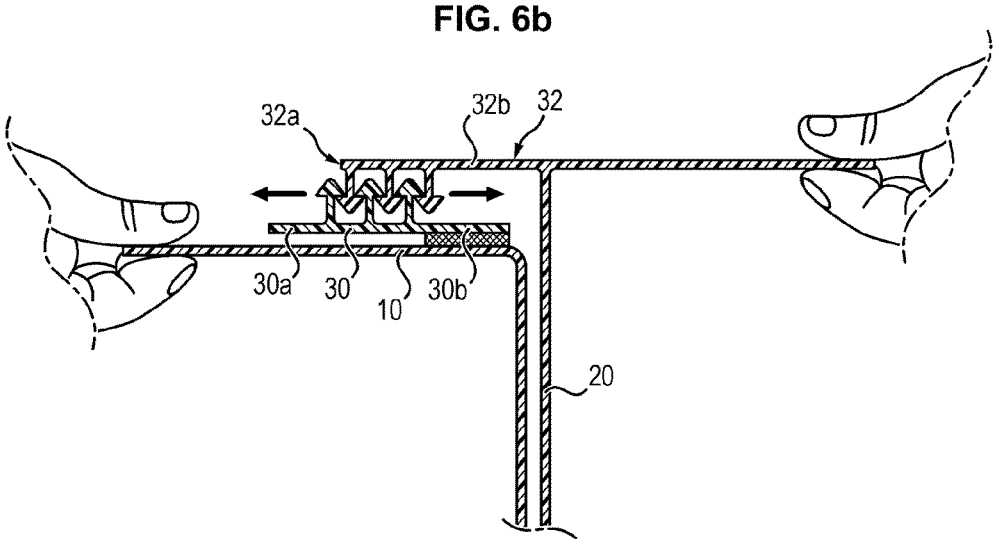
FIG. 6*b* is a sectional view of the bag of FIG. 6*a*, along axis B-B illustrated in FIG. 6*a*.

By way of comparison, as illustrated in FIGS. 6*a* and 6*b*, when the user tries to open a bag 1 conventionally comprising a hinge (areas 31 or 33), the effect of traction force applied to the walls 10, 20 is to have the closure assembly turned and aligned with the direction of application of this force (see the arrows in FIG. 6*b*), or perpendicularly to the direction of separation of the closure elements 34 (said direction of separation extending perpendicularly to the plane of the support webs 30, 32). The result is that the closure elements 34 remain engaged and prevent the bag 1 from opening.

Connected here means that the support web 30, 32, is either applied to and fixed, for example by welding, on the associated wall, or formed (i.e., formed fully and in a single piece) with said wall 10, 20. The welding can be of thermal welding type, ultrasound welding, for example by points, or the two (made successively).

Of course, the first and the second support web 30, 32 can be connected according to identical or different techniques to the associated wall 10, 20: for example, the first support web 30 can be applied to and fixed on the first wall 10 while the second support web 32 can be formed with the second wall 20, or vice versa.

In an embodiment, the passage 40 extends along a substantial height of the first support web 30 to let the user better block the movements of the first support web 30.

The first support web 30 can for example be divided into several consecutive sections, each corresponding to a part of the first support web 30 which is or is not welded onto the first wall 10.

Figure 5:
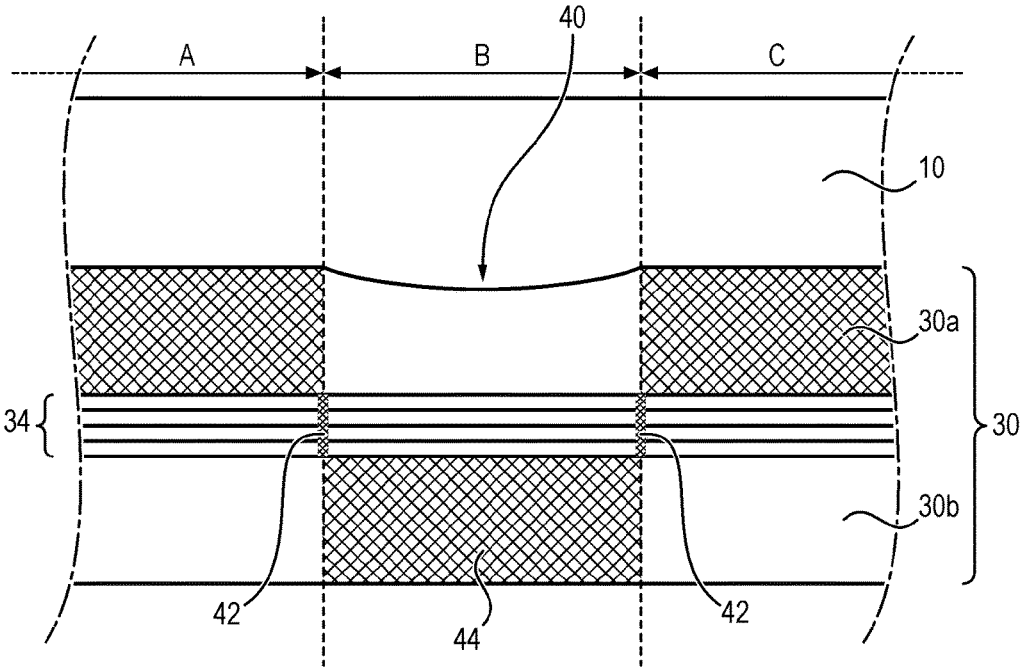
FIG. 5 is a detailed view of an embodiment of a passage enabling easy opening of a bag according to the invention.

For example, in an embodiment illustrated in FIG. 5 the first support web 30 can be divided into three sections A, B, C:

- a first section A which extends between one of the lateral sides of the bag 1 and the passage 40, wherein the first support web 30 is connected to the first wall 10,
- a second section B, which extends along the passage 40, wherein the first support web 30 is not connected on at least one part of its height to the first support web 30, so as to create the passage 40, and
- a third section C, which extends between the other of the lateral sides of the bag 1 and the passage 40, wherein the first support web 30 is connected to the first wall 10.

The first support web 30 is well connected discontinuously over its length to the first wall 10 of the bag 1, since it is not fixed on at least one part of its height to the first wall 10 along the second section B.

Here length means the dimension which extends along the direction of extension of the closure assembly 3 and which extends between the lateral sides of the bag 1. Also, height means the dimension which extends perpendicularly to the direction of extension of the closure assembly 3 and which extends between the mouth and the bottom 2 of the bag 1.

It is clear that the bag 1 can comprise more sections, including two separate sections in which the first support web 30 is not connected to the first wall 10 over part of its height.

In an embodiment, the passage 40 can extend over the entire height of the upper part 30*a* of the first support web 30, or optionally as far as an area subjacent to the closure element 34. For this, the upper part 30*a* of the first support web 30 can be connected to the first wall 10 in the first and third sections A, C, for example by welding, while it is left free (not welded) along the second section B.

As a variant, the upper part 30*a* of the first support web 30 can comprise a local notch at the second section B and connected to the first wall 10 along the first and second sections A, C. The notch can especially be obtained by cutting of the upper part of the first support web 30, at the second section B.

In an embodiment, for easy opening of the closure assembly 3, the lower part 30*b* of the first support web 30 is connected continuously over all or part of its height to the first wall 10 of the bag 1 in the area which extends facing the passage 40. This continuous link of the lower part 30*b* in the extension of the passage 40 increases the force applied by the first wall 10 to the closure elements 34 in the direction of separation, and therefore simplifies their separation and the opening of the closure assembly. In an embodiment, only a lower area, subjacent to the closure element 34, of the lower part 30*b* of the first support web 30 is connected to the first wall 10 (see FIG. 5). In this way, the user can introduce his thumb into the passage beyond the closure element 34, making it easy to initiate separation of the closure elements 34.

Typically, in the embodiment illustrated in FIG. 5, the lower part 30*b* of the first support web 30 is connected on a part of its height to the first wall 10 along the second section B (see the hatched area 44).

Optionally, to stiffen the fastening of the lower part 30*b* of the first support web 30 on the first wall 10, transversal weldings 42 can also be made at the border between the first and the second section A, B on the one hand and at the border between the second and the third section B, C on the other hand (irrespective of the height on which the lower part 30*b* is welded to the first wall). It is evident that in addition to stiffening fastening of the first support web 10, such transversal weldings 42 ensure sealing between the exterior and the interior of the bag 1 at the second section B, despite the presence of the passage 40.

At the level of the first and third sections A, C, the lower part 30*b* can be left free (as illustrated in FIG. 5, on which the hatched areas represent the welded parts of the first support web 30) or connected continuously to the first wall 10 of the bag 1 over all or part of its height, in which case the lower part 30*b* is connected to the first wall 10 from one lateral side of the bag 1 to the other.

To enable the passage 40 of a thumb, preferably the thumb of an adult, the passage 40 has a length, in the direction of extension of the closure assembly 3 between the lateral sides of the bag 1, comprised between 12 mm and 35 mm.

In an embodiment, the passage 40 is closer to one of the sides of the bag 1 than the other of said sides so as not to be extended centrally. In this way, the passage 40 is less likely to be stressed when the bag 1 is being handled. Typically, the edge of the passage 40 can extend to a distance comprised between 10% and 30% of the distance between the lateral sides of the bag 1, i.e., for a bag 1 having a length between the lateral sides of 100 mm, the edge of the passage 40 extends to a distance comprised between 10 mm and 30 mm of one of the lateral sides.

In an embodiment, each closure element 34 comprises several complementary profiles, as illustrated in FIGS. 3 to 11, preferably between three and six complementary profiles, for example five.

The presence of several complementary profiles 34 in fact makes engagement of the closure assembly 3 from the external faces of the walls 10, 20 of the bag 1 easy, by reducing the precision needed to ensure their closing. It also ensures better resistance to the internal and external stresses of the walls 10, 20 of the bag 1.

The complementary profiles 34 can be of male/female, male/male (profiles in the form of an arrow, as illustrated in the figures) velvet/hook type, or even complementary hooks type.

The complementary profiles 34 can be altered sequentially by forming successive alterations along the complementary profiles 34 in a direction transversal to the support webs. The sequential alterations are local sequential modifications of the complementary profiles 34, which can especially comprise sequential crushings and/or sequential incisions without removal of material (i.e., either only sequential crushings or only sequential incisions, or both sequential crushings and sequential incisions) and/or sequential notches with removal of material. Reference could be made especially to international application No. EP2012/073186 in the name of the applicant, which describes embodiments of sequential alterations.

In an embodiment, all or part of the complementary profiles 34 can comprise sequential alterations. So several complementary profiles 34 can comprise sequential alterations while at least one complementary profile 34 can remain intact, or vice versa.

In the following, examples of closure assemblies 3 will now be described in relation to attached FIGS. 1 to 4. However these are non-limiting embodiments, to the extent where the invention applies to any closure assembly 3 comprising support webs 30, 32, formed on the walls 10, 20 of the bag 1 or applied to and fixed on said walls 10, 20, comprising closure elements 34.

In these embodiments the second support web 32 can be hinged on the second wall 20 such that traction on the walls of the bag 1, when the complementary closure elements 34 are engaged, causes the rotation of the support webs 30, 32 around said complementary closure elements 34.

According to a first embodiment illustrated in FIG. 1, the second support web 32 is fixed on the second wall 20 in a localized area 33 which is not superposed with the closure element 34 and which is offset relative to said closure element 34, such that the second support web 32 is hinged on the second wall 20. Such fastening has been described for example in document FR 2 628 067 in the name of the applicant, the content of which is incorporated here by reference.

As described in document FR 2 628 067, the above arrangement prevents internal pressure on the bag 1 from being applied to the closure elements 34 and tends to separate the latter. In fact, because of this arrangement, the separation of the walls of the bag 1 (for opening the latter) results in possible pivoting of the support web at the hinge area formed by its fastening, without risk of separation of the closure elements 34.

In document FR 2 628 067, the localized area extends at the upper part 32*a* of the second support web 32 to avoid the risk of opening of the bag 1 resulting from internal pressure applied by the contents of the bag 1 on the closure assembly 3.

As a variant, the localized area can extend in the lower part 32*b* of the second support web 32 to prevent opening of the bag 1 from the exterior. To further reduce the possibility of opening the bag 1, especially by children, the upper part 32*a* of the second support web 32 can have reduced height. In this way, grasping the second support web 32 could not be possible, requiring use of the passage 40. For example, the height of the second support web 32 can be less than the height of the closure element 34. In an embodiment, the height of the upper part of the second support web can be less than or equal to 1 mm.

Figure 2:
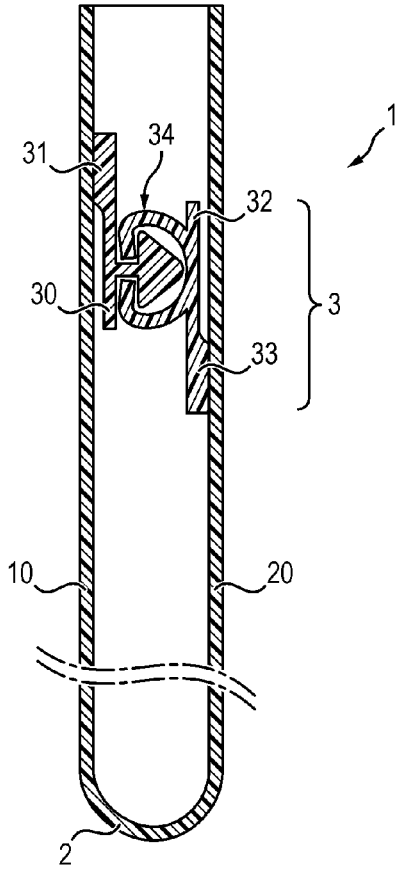
FIG. 2 illustrates a sectional transversal view of a second embodiment of a bag according to the invention, the bag being at rest.

According to yet another variant (second embodiment) illustrated in FIG. 2, the two support webs 30, 32 can be connected to the wall 10, 20, in front, at a localized area 31, 33. The localized areas 31, 33 can be arranged on respective opposite parts of the support webs 30, 32 (here the upper part 30*a* and the lower part 32b), respectively on either side of the closure complementary elements 34, such that one of the hinged webs (here the first support web 30) is directed towards the interior of the bag 1 while the other hinged web (here the second support web 32) is directed towards its mouth. Such a configuration is for example described in document FR 2 963 927 in the name of the applicant, the content of which is incorporated here by reference, and illustrated in FIG. 2. Alternatively, the localized areas 31, 33 can be arranged on respective parts of the support webs 30, 32 which extend in front, i.e., on the upper parts 30*a*, 32*a* of the webs 30, 32 or on their lower part 30*b*, 32*b*.

Figure 3:
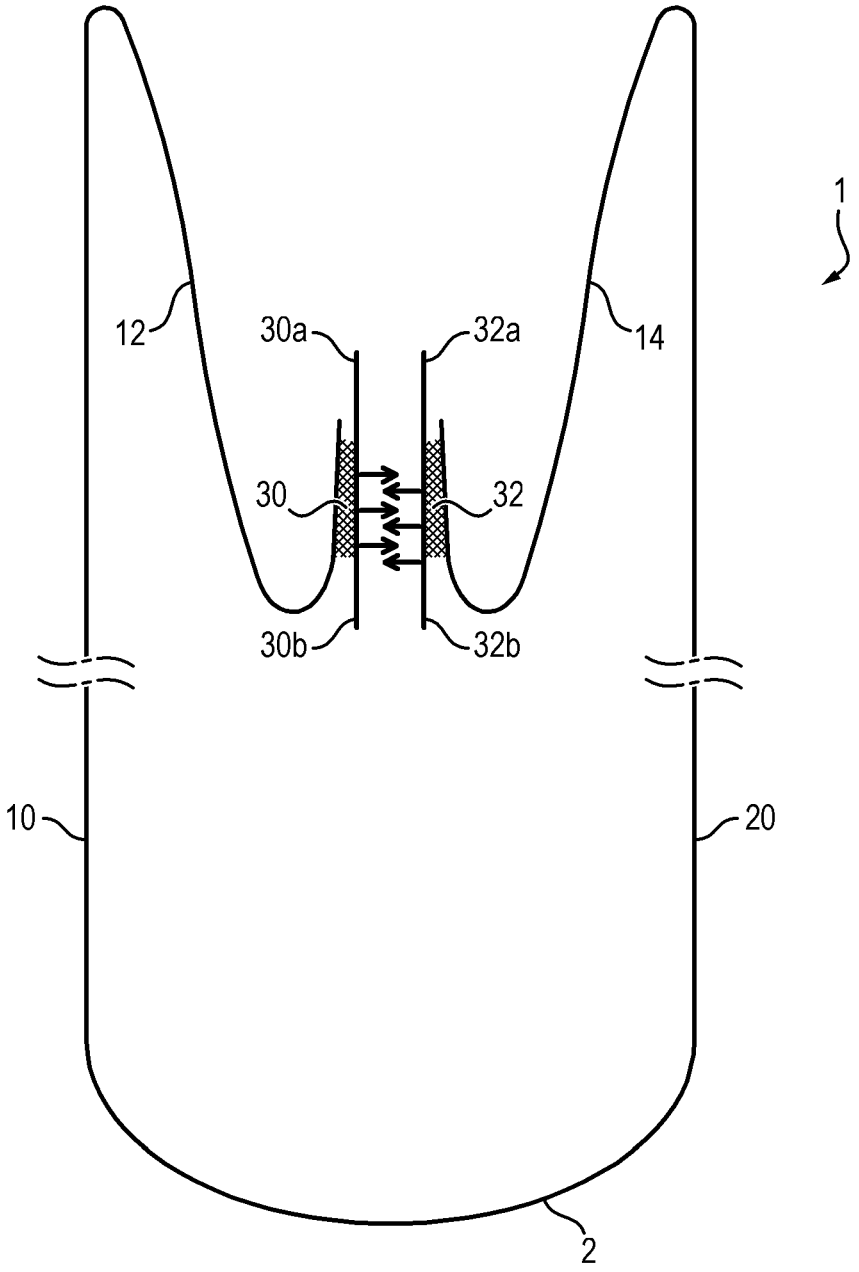
FIG. 3 illustrates a sectional transversal view of a third embodiment of a bag according to the invention, the bag being at rest.

According to a third embodiment illustrated in FIG. 3, the first and the second support web 30, 32 can be connected to the first and to the second wall 10, 20 by means of a first and a second extension web 12, 14, respectively, at least one of the support webs 30, 32 being fixed to the extension web at a distance from its upper part 30*a*, 32*a*. Such fastening has been described for example in document FR 14 58288 in the name of the applicant, the content of which is incorporated here by reference.

In document FR 14 58288, the support web 30, 32 can be fixed to the corresponding extension web 12, 14 in an adjacent area to the complementary closure element 34 carried by said support web 30, 32. In a variant embodiment, the two support webs 30, 32 are each connected to an extension web 12, 14 associated.

Figure 4A:
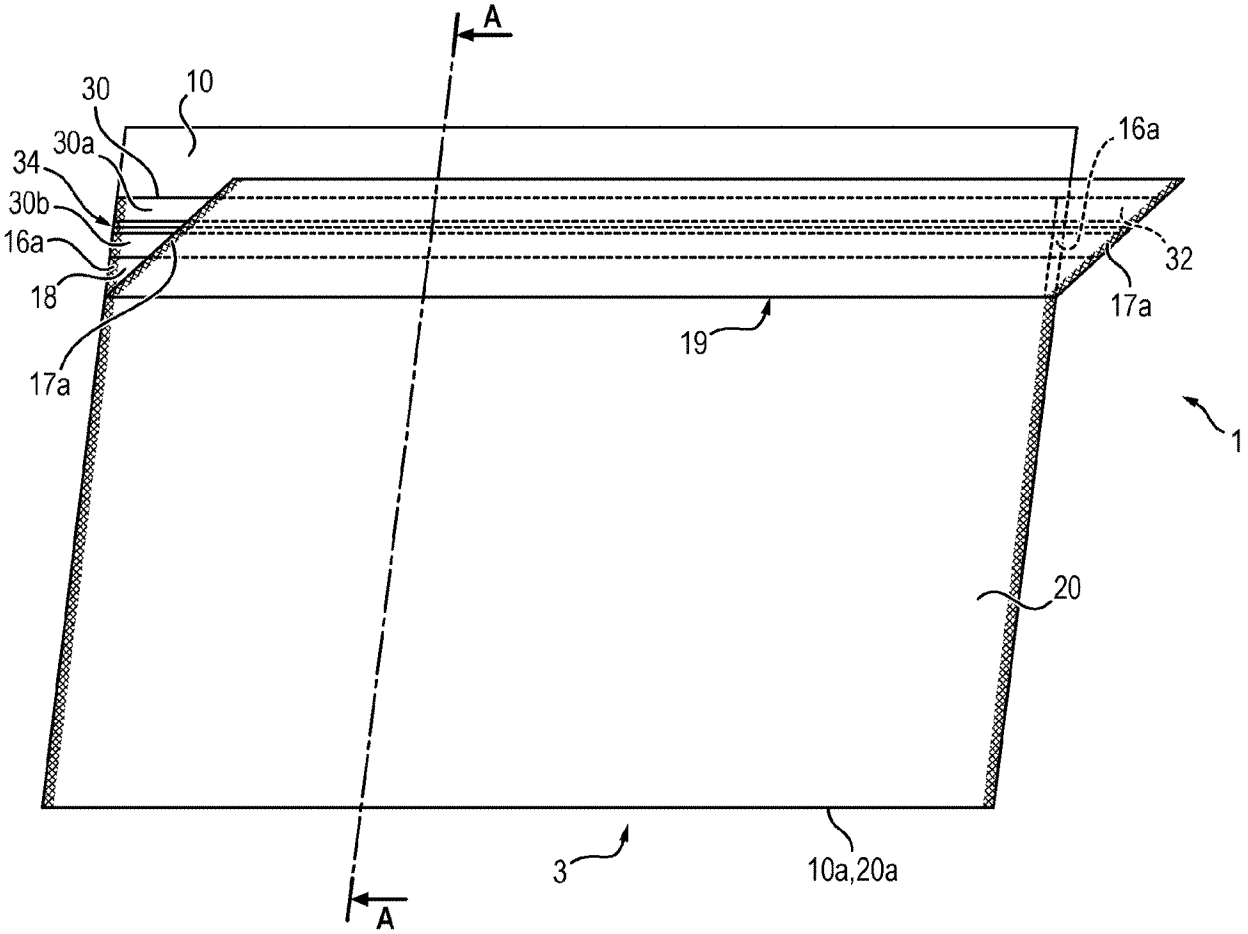
FIG. 4*a* is a perspective view of a fourth embodiment of a bag according to the invention.
Figure 4B:
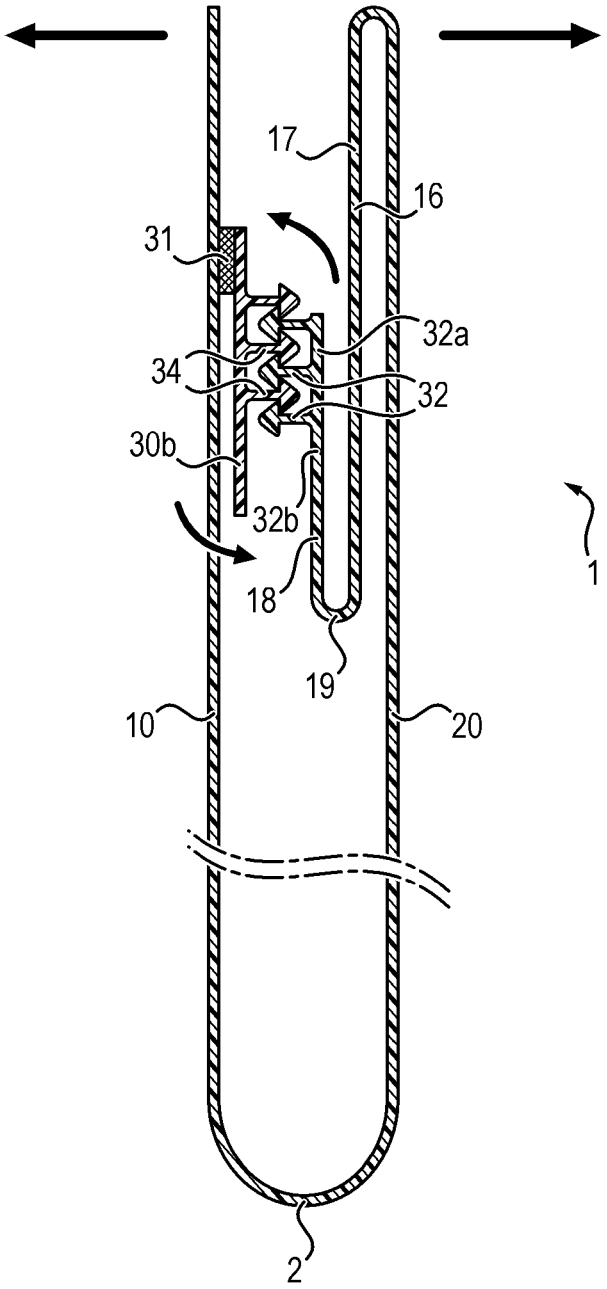
FIG. 4*b* illustrates a sectional transversal view according to the axis A-A of the bag of FIG. 4*a*, when the bag is at rest.
Figure 4C:
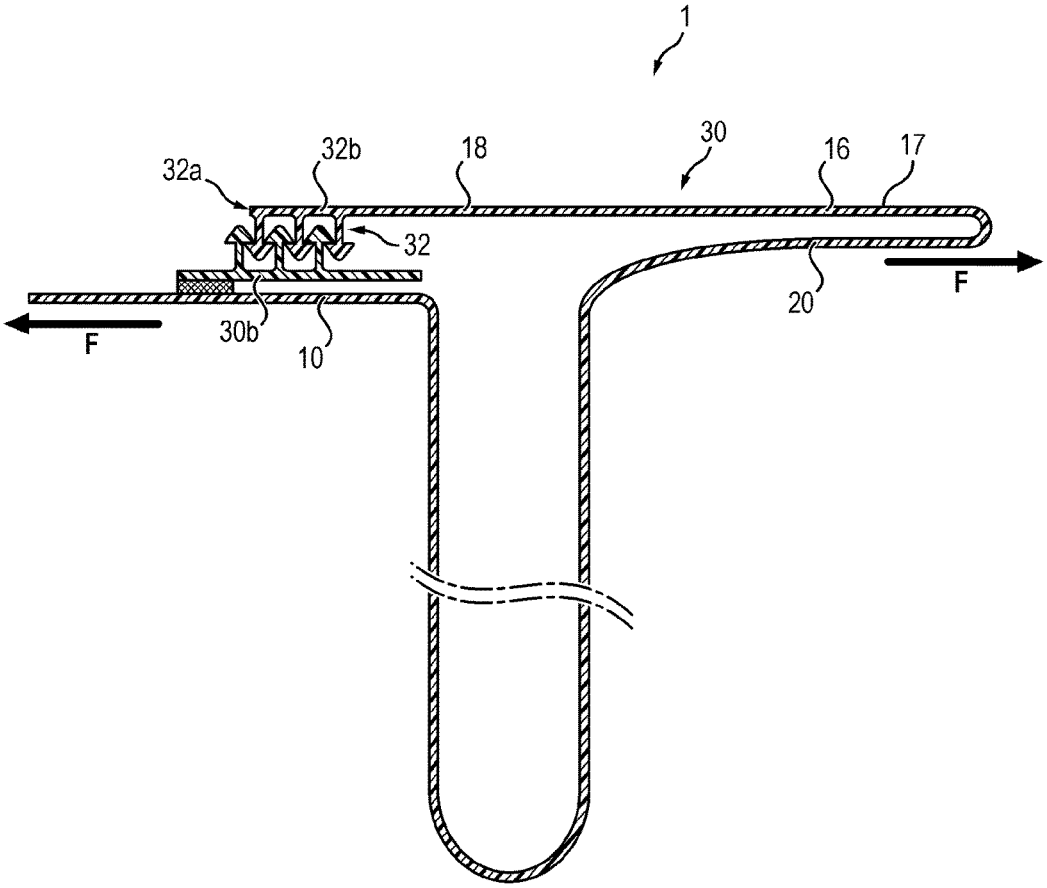
FIG. 4*c* illustrates a sectional transversal view according to the axis A-A of the bag of FIG. 4*a*, when a person applies traction force to the walls of the bag to separate the complementary profiles from the closure device.

According to a fourth embodiment illustrated in FIGS. 4*a* to 4*c*, the bag 1 further comprises a supplementary wall 16 having a first panel 17 and a second panel 18. The first panel 17 of the supplementary wall 16 is connected to the second wall 20 near the mouth of the bag 1 while the second panel 18 is connected to the first wall 10. The supplementary wall 16 can be formed fully and in a single piece with the second wall 20 of the bag 1, or as a variant applied to and fixed on said second wall 20, near its upper edge so as to extend towards the bottom of the bag 1, or according to yet another variant applied to and fixed on said second wall 20 at a distance from its upper edge, for example in a region adjacent to the fold. The supplementary wall 16 is folded between the first panel 17 and the second panel 18 along a fold 19 such that the second panel 18 extends in the direction of the mouth. Also, the first support web 30 is fixed on the second wall 20 and the second support web 32 is fixed on the second panel 18 of the supplementary wall 16. More precisely, the first support web 30 and the second support web 32 are fixed on the first wall 10, the second support web 32 being further fixed on the second panel 18 of the supplementary wall 16, such that stress from moving apart the first and of the second wall 10, 20 of the bag 1 when the complementary profiles 34 are engaged causes the rotation of the closure device around the second support web 32.

This configuration radically reduces the risk of opening of the bag 1 by a small child and the risk of unintentional opening of the bag 1 due to internal stresses applied by the contents of the bag 1 on the closure device. In fact, the effect of moving apart the upper edges of the bag 1 or walls between the support webs and the bottom of the bag 1 is to have the support webs 30, 32 of the closure device pivot zo and aligned with the axis of application of forces on the walls (overall horizontally) due to the presence of the supplementary wall 16 which is deployed and fastening of the first support web 30 on the first wall 10. In this way, any additional force on the support webs 30, 32 is applied in the plane of the support webs 30, 32, and no longer perpendicularly to the latter.

In an embodiment, the first panel 17 of the supplementary wall 16 extends towards the interior of the bag 1. Optionally, the first panel 17 of the supplementary wall 16 can be welded on the lateral sides of the second wall 20, along the two weld lines 17*a* (see FIG. 4*a*).

The second panel 18 of the supplementary wall 16 is fixed on the lateral sides of the first wall 10, at the support webs 30, 32.

Here, the second panel 18 of the supplementary wall 16 is also welded on the lateral sides of the first wall 10, between the lower part 32*b* of the second support web 32 and the fold 19 (see FIG. 4*a*) along the two weld lines 16*a*. In this embodiment, the second support web 32 therefore extends at a distance from the fold 19 and is not fixed on the portion of the second wall 20 which extends facing the first panel 17 of the supplementary wall 16.

It is evident that this configuration has the advantage of allowing alignment of the portion of the second wall 20 with the portion facing the first wall 10, as illustrated in FIG. 4*c*, when a user pulls on their upper edges of the bag 1 to access the inside of the bag 1. In this configuration, forces are applied mainly to the ends of the support webs 30, 32 which are fixed on the lateral sides of the first wall 10, a minority of forces being also applied to the lower part 32*b* of the second support web 32 and on the upper part 30*a* of the first support web 30, in the plane of said webs 30, 32. Such forces however are not likely to separate the complementary profiles 34 from the closure device.

In this configuration, the first and the second wall 10, 20 can be fixed on each other along their lateral sides, between their lower edge and the fold 19, as illustrated in FIG. 4*a*.

As a variant, the first wall 10 and the second wall 20 can be joined together over their entire height along their lateral sides, i.e., from the bottom of the bag as far as their upper edge, by welding or by adhesion. In this variant of use, the opening of the bag 1 by traction on the upper edges of the first and of the second wall 10, 20 is even more difficult, with possible moving apart of the upper edges of walls 10, 20 limiting pivoting of the supplementary wall 16 and therefore the force which can be applied to the complementary profiles 34.

In the example of FIGS. 4*a* to 4*c*, the first support web 30 is fixed on the first wall 10 at its upper part 30*a* only, its lower part 30*b* remaining free relative to the first wall 10. This configuration in fact heightens the hinge effect of the closure device by enabling the pivoting of the first support web 30 when the walls 10, 20 of the bag 1 are moved apart.

Figure 11:
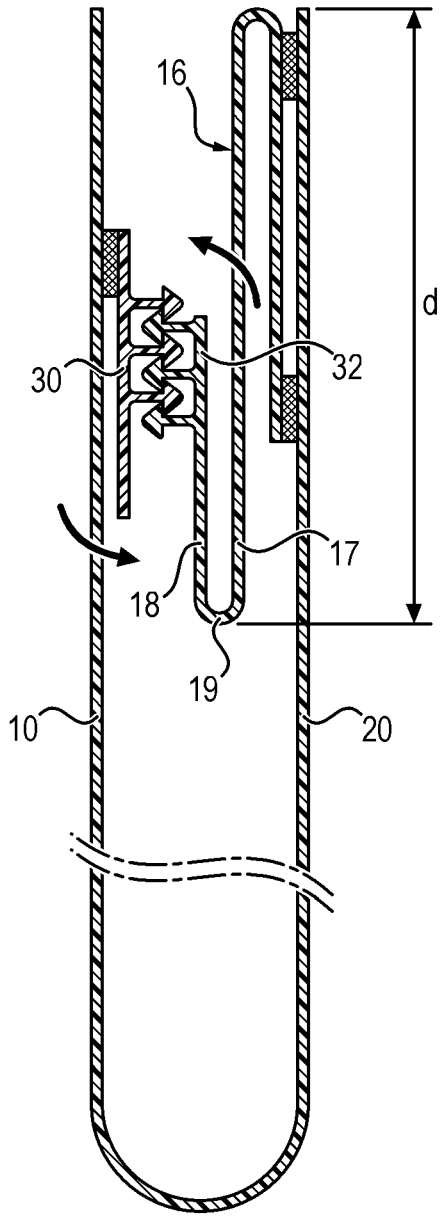
FIG. 11 illustrates a sectional view of a fifth example of a bag according to the invention, when the bag is at rest.

Also, the height of the upper part 32*a* of the second support web 32 is such that said upper part 30*a* does not exceed the complementary profiles 34 (as illustrated in FIGS. 4*b*, 4*c* and 11 for example). In other terms, the complementary profiles 34 arrive at the limit of the support web 32.

It is evident that the presence of the supplementary wall 16 and fastening of the closure device at a distance from the upper edge of the walls 10, 20 offsets the closure device towards the interior of the bag 1 rather than at its mouth, further reinforcing the tendency of children to grasp the walls 10, 20 of the bag 1 rather than trying to grip the support webs 30, 32, and reduces the risk of the child seeing the closure device when the bag 1 is placed on a support.

This tendency can be further reinforced by fixing the closure device such that the fold 19 extends at a distance d of the order of the length of a thumb of an adult from the mouth (when the bag 1 is at rest), or a distance d comprised between 30 and 70 millimeters, typically of the order of forty millimeters for a bag 1 having a width of twenty centimeters (see FIG. 11). An adult will now have no difficulty in opening the bag 1, by placing his thumb at the bottom of the fold 19, whereas a small child will have difficulty in introducing his thumbs into the fold 19 and into the passage 40, his hands being too small. The child could therefore grasp only the upper edges of the walls 10, 20, which does not open the bag 1.

Such fastening has been described for example in document FR 15 53143 in the name of the applicant, the content of which is incorporated here by reference.

In document FR 15 53143, the second panel 18 of the supplementary wall 16 can also be fixed near the lateral sides of the first wall 10, between the second support web 32 and the fold 19 to make opening of the bag 1 by simple traction on the mouth more difficult.

FIG. 11 illustrates a fifth embodiment of a bag 1.

This fifth embodiment differs from the example illustrated in FIGS. 4*a* to 4*c* only in that the supplementary wall 16 is applied to and fixed on the second wall 20. The other characteristics described in relation to the fourth embodiment therefore apply mutatis mutandis to this fifth embodiment.

The second wall 20 can however be of a length similar to that of the first wall 10, since it is not necessary to fold it to form the supplementary wall. The supplementary wall 16 is however folded along the fold 19, between the first panel 17 and the second panel 18, so as to extend in the direction of the mouth of the bag 1.

In this embodiment, the first panel 17 therefore also extends along the second wall 20, between its upper edge and the fold 19, while the second panel 18 which comprises the second support web 32 extends between the fold 19 and the end free of the supplementary wall 16.

It is evident that, irrespective of the embodiment, the second support web 32 could also be applied to and fixed on the supplementary wall 16.

Also, as indicated earlier, the upper part 32*a* of the second support web 32 cannot extend beyond the complementary profiles 34. In other terms, the complementary profiles 34 can extend as far as the limit of the second support web 32.

The resulting bag 1 is therefore capable of resisting internal stresses (due to the bulk of the contents of the bag 1) and external stresses (due to action by a person—adult or child—on the mouth 2) of the walls 10, 20 of the bag 1, preventing any conventional opening of the bag 1 (via traction on the upper edges 10*c*, 20*c* of the walls 10, 20), even by an adult. In fact, when the complementary profiles 14, 24 are engaged, the stress from moving apart the walls 10, 20 of the bag 1 (i.e. perpendicularly to the walls 10, 20 of the bag 1 according to arrows F of FIGS. 4*b* and 4*c*) causes tension of the second wall 20 and of the supplementary wall 30 and rotation of the closure device about the second support web 22 until the support webs 12, 22, the second wall 20 and the supplementary wall 30 align overall with the direction of application of forces F. This alignment, as in FIG. 2*b*, prevents any opening of the bag 1, even by an adult.

To open a bag 1 according to the fourth or fifth embodiment, it is possible to use the passage 40, as described hereinabove.

As a variant, in an embodiment the bag 1 can be devoid of such a passage. It is then possible to squeeze the support webs 30, 32 to move the complementary profiles 34 in opposite directions (shearing). The free ends of the support webs 30, 32 being fixed to the lateral sides of the first wall 10, the effect of this squeezing is to separate the complementary profiles 34 near one of these edges.

The difficulty of opening by squeezing the support webs 30, 32 can be adjusted by welding the lateral sides of the first and of the second wall 10, 20 over their entire height.

This difficulty can also be adjusted by modifying the position of the closure device relative to the fold 19 and/or the mouth of the bag 1. In fact, the applicant noticed that the further the lower part 32*b* of the second support web 32 was moved away from the fold 19, the more it was difficult to separate the complementary profiles by squeezing, with the supplementary wall 16 tending to dissipate the forces applied to the bag 1. A distance between the limit of the complementary profiles 34 (at the lower part 32*b*) and the fold 19 can for example be of the order of 5 to 30 mm, typically 25 mm.

Also, the closer the closure device is to the mouth, the more the users (adults or children) tend to grip the device by the complementary profiles 34 and not by their lower parts 30*b* 32*b*, making the relative shift of the support webs 30, 32 and therefore separation of their profiles 34 more difficult. It is evident that this squeezing of the support webs 30, 32 is not evident for children who naturally tend to grasp the bag 1 by its walls 10, 20. But the opening of the bag 1 by stressing the upper edges of the walls 10, 20 is not possible (without destroying the closure device of the bag 1) due to rotation of the support webs 30, 32.

Also, only substantial squeezing of the support webs 30, 32 would be suitable for opening the bag 1. But such force is too intense for a child who therefore could not access the contents of the bag 1.

Irrespective of the embodiment, the walls 10, 20 of the bag 1 can be made of opaque (non-transparent) material to reduce the possibility for children of seeing the closure assembly 3 through the walls 10, 20.

The walls 10, 20, the support webs 30, 32 and the complementary closure elements 34 can be made from a single and unique material, especially one of the following materials: polypropylene PP, polyethylene terephthalate PET, polyethylene PE, high-density polyethylene HDPE, low-density polyethylene LDPE and their associated copolymers, ethylene copolymers and/or propylene copolymers.

As a variant, these different elements of the bag 1 can be made from different materials. Particular, but non-limiting, examples are a bag 1 comprising a first wall 10 and a second wall 20 made of polyethylene terephthalate and/or polyethylene and a closure assembly 3 (support webs 30, 32 and complementary closure elements 34) made of polypropylene.

Also, the first and the second wall 10, 20 can have a thickness comprised between 30 micrometers and 200 micrometers, typically of the order of 60 micrometers to 150 micrometers, especially when said walls are formed from one of the materials described hereinabove. It is evident of course that these walls can be made of complex materials comprising several layers of different materials.

The invention claimed is:

1. A bag comprising:

a first and a second wall connected together so as to define lateral sides and a bottom of the bag, a closure assembly comprising a first and a second support webs connected respectively to the first and to the second wall and each comprising a complementary closure element, the first support web being discontinuously connected over its length to the first wall of the bag so as to create at least one passage between this first support web and the first wall of the bag from the outside of the bag, said passage enabling local deformation of the first support web for modifying the relative local orientation of the closure elements when the walls of the bag are moved apart and making separation of the complementary closure elements easier, wherein the first support web has an upper edge and a lower edge, the lower edge being closer to the bottom of the bag than the upper edge, the upper edge of the first support web being continuously fixed to the first wall along a first section and being separated continuously from said first wall along a second section so as to create the passage, and wherein the first support web is divided into a lower part, an upper part and a middle part located between the lower part and the upper part.

wherein the middle part bears the closure element, wherein the lower part is closer to the bottom than the upper part extends to a subjacent area of the closure element, wherein the lower part of the first support web is continuously fixed on the first wall along the second section either over all its height.

2. A bag comprising:

a first and a second wall connected together so as to define lateral sides and a bottom of the bag, a closure assembly comprising a first and a second support webs connected respectively to the first and to the second wall and each comprising a complementary closure element, the first support web being discontinuously connected over its length to the first wall of the bag so as to create at least one passage between this first support web and the first wall of the bag from the outside of the bag, said passage enabling local deformation of the first support web for modifying the relative local orientation of the closure elements when the walls of the bag are moved apart and making separation of the complementary closure elements easier, wherein the first support web has an upper edge and a lower edge, the lower edge being closer to the bottom of the bag than the upper edge, the upper edge of the first support web being continuously fixed to the first wall along a first section and being separated continuously from said first wall along a second section so as to create the passage wherein the bag further comprises transversal weldings made at the border between the first section and the second section.

3. The bag according to one of claim 1 or 2, wherein the lower edge of the first support web is continuously connected to the first wall between the lateral sides of the bag.

4. The bag according to claim 1 or 2, wherein the upper part of the first support web is discontinuously connected to the first wall so as to create the passage.

5. The bag according to claim 1 or 2, wherein the upper part of the first support web is locally cut out so as to create the passage.

6. The bag according to claim 1 or 2, wherein the passage has a length, in the direction extending between the sides of the bag, comprised between 12 mm and 35 mm.

7. The bag according to claim 1, wherein the second support web is hinged on the second wall such that the traction on the walls of the bag when the complementary closure elements are engaged causes the rotation of the support webs around said complementary closure elements.

8. The bag according to claim 7, wherein the second support web is fixed on the second wall in a localized area which is not superposed with the closure element and which is offset relative to said closure element, such that the second support web is hinged on the second wall.

9. The bag according to claim 8, wherein the second support web is divided into a lower part and an upper part, the lower part being closer to the bottom than the upper part and bearing the closure element, and wherein the localized area at which is fixed the second support web on the second wall forms part of the lower part of said second support web.

10. The bag according to claim 9, wherein the upper part of the second support web has a height less than a height of the closure element.

11. The bag according to claim 7, wherein the first and the second support web are connected to the first and to the second wall by means of a first and a second extension web, respectively, at least one of the support webs being fixed to the extension web at a distance from its upper edge.

12. The bag according to claim 11, wherein the at least one support web is fixed to the corresponding extension web in an area adjacent to the complementary closure element carried by said support web.

13. The bag according to claim 7, further comprising a supplementary wall having a first panel and a second panel, the first panel being connected to the second wall near the mouth of the bag while the second panel is connected to the first wall, said supplementary wall being folded between the first panel and the second panel along a fold such that the first panel extends in the direction of the bottom, and wherein:

the first support web and the second support web are fixed on the first wall, and the second support web is further fixed on the second panel of the supplementary wall.

14. The bag according to claim 13, wherein the second panel of the supplementary wall is fixed near the lateral sides of the first wall, between the second support web and the fold.

15. The bag according to claim 1, wherein the complementary closure elements each comprise at least one complementary profile.

16. The bag according to claim 15, wherein all or part of the complementary profiles comprises sequential alterations substantially parallel to the lateral sides, sequential crushings.

17. The bag according to claim 15, wherein the complementary closure elements each comprise at least two complementary profiles.

18. The bag according to claim 15, wherein the complementary closure elements each comprise between three and six complementary profiles.

* * * * *